US005304026A

United States Patent [19]

Liaw et al.

[11] Patent Number: 5,304,026

[45] Date of Patent: Apr. 19, 1994

[54] MULTI-STORY, TRANSVERSE SHIFTING TYPE AUTOMATIC PARKING DEVICE

[75] Inventors: Robert Liaw, 1F, No. 4, Chie-Shang Street, Shin Tan City, Taipei; Timothy Fu, Taipei; K. M. Ling, Taipei; Adam Wu, Taipei, all of Taiwan

[73] Assignee: Robert Liaw, Taipei, Taiwan

[21] Appl. No.: 782,230

[22] Filed: Oct. 24, 1991

[51] Int. Cl.[5] ..... E04H 6/12

[52] U.S. Cl. ..... 414/257; 414/253; 414/264

[58] Field of Search ..... 414/233, 234, 235, 239, 414/240, 253, 257, 264, 277, 278; 187/8.41, 8.45, 8.62, 8.64, 8.65, 8.69, 8.74, 16, 17, 15

[56] References Cited

U.S. PATENT DOCUMENTS

| | | | |
|---|---|---|---|
| 1,303,978 | 5/1919 | Smith | 187/16 X |
| 1,800,079 | 4/1931 | Johnston | 414/264 |
| 1,896,063 | 2/1933 | Bottini | 414/253 X |
| 1,955,959 | 4/1934 | Harnischfeger et al. | 414/233 X |
| 2,303,656 | 12/1942 | Orr | 414/234 X |
| 2,848,121 | 8/1958 | Semler | 414/240 |
| 3,190,467 | 6/1965 | English | 414/234 |
| 3,680,718 | 8/1972 | Miyachi | 414/239 |
| 5,069,592 | 12/1991 | Galperin | 414/240 |

FOREIGN PATENT DOCUMENTS

| | | | |
|---|---|---|---|
| 0009274 | 1/1977 | Japan | 414/233 |
| 989859 | 4/1965 | United Kingdom | 414/235 |

*Primary Examiner*—David A. Bucci
*Assistant Examiner*—Stephen Gordon
*Attorney, Agent, or Firm*—Lowe, Price, LeBlanc & Becker

[57] ABSTRACT

A multi-story transverse shifting type automatic parking device is described which is suited for a multi-story parking building. Each floor of the building is divided into at least one row of equal blocks, each row of equal blocks being formed with an elevator passage way centrally located and at least two parking units on the opposite sides of the elevator passage way. At least one lifting gearframe is installed in the elevator passage way and is driven horizontally from one row to another with a lifting gear mainframe which includes a mother elevator driven vertically and a multi-story daughter elevator driven to move vertically in the mother elevator. A plurality of pairs of transverse shifting mechanisms respectively fastened in each floor of the building are provided and each pair of which are fastened at opposite sides of the elevator passage way. A plurality of carriers respectively placed on the parking units on each floor in the multi-story parking building and are also placed in the multi-story daughter elevator. A car then is parked in the parking unit on a particular floor by moving the mother and daughter elevators and the transverse shifting mechanisms.

5 Claims, 9 Drawing Sheets

MULTI-STORY, TRANSVERSE SHIFTING TYPE AUTOMATIC PARKING DEVICE

BACKGROUND OF THE INVENTION

The present invention relates to automatic parking devices and relates more particularly to a multi-story, transverse shifting type automatic parking device which utilizes a mother elevator with a multi-story daughter elevator therein to match with a plurality of transverse shifting mechanisms for carrying a car to any parking unit on any floor. By means of the arrangement of the present invention, many parking units can be provided in the same unit area.

Due to an increasing number of cars, it has become the common problem for people living in big cities in the world to find a parking space for parking a car. However, it is very difficult to build sufficient parking lots in the limited land space in cities. In order to fully utilize the limited land space in cities, several parking devices have been disclosed, which include:

(A) Multi-deck parking device, which is to set up several parking units in a unit parking space with one above another for parking several cars by means of the operation of a lifting mechanism. A disadvantage of this structure of multi-deck parking device is that it can not be extended sidewards. Further, the car parked at the bottom deck should be moved out before parking a car at the topmost deck or taking it therefrom. Therefore, this structure of parking device is less effective in use.

(B) Horizontal circulation parking device, which is to utilize the basement of a building for parking cars by means of the operation of a horizontal circulation mechanism.

(C) Cage-delivered multi-story parking device, which utilizes a cage moved by a belt conveyer circulation system for carrying a car to either parking unit in either floor for parking.

These horizontal circulation parking device and cage-delivered multi-story parking device may make use of transversely or longitudinally extended space for parking cars. However, when parking or taking a car, the desired parking unit shall be moved to a common entrance. Therefore, much time is required in parking or taking a car and, high flow rate can not be achieved.

(D) Elevator-delivered multi-story parking device, which utilizes an elevator for carrying a car to either floor in a building for parking. This structure of elevator-delivered multi-story parking device is still not satisfactory in use because it can not eliminate the disadvantages as described in the cage-delivered multi-story parking device.

SUMMARY OF THE INVENTION

The present invention has been accomplished to eliminate the aforesaid disadvantages. It is therefore an object of the present invention to provide a multi-story, transverse shifting type automatic parking device which provides high capacity in a limited land space and which is extendible and suitable for high flow rate operation. It is another object of the present invention to provide a multi-story, transverse shifting type automatic parking device which combines the advantages of the elevator type and horizontal circulation type of parking devices and, in which elevators are used to lift cars from the ground floor quickly and at least two parking units are provided in either floor at either side by the common elevator passage way thereof. It is still another object of the present invention to provide a multi-story, transverse shifting type automatic parking device, which can be expanded by combining several independent parking devices together with the elevator passage ways and traffic lanes thereof respectively aligned for parking more cars efficiently.

DETAILED DESCRIPTION OF THE PREFERRED EMBODIMENT

Figure 1:
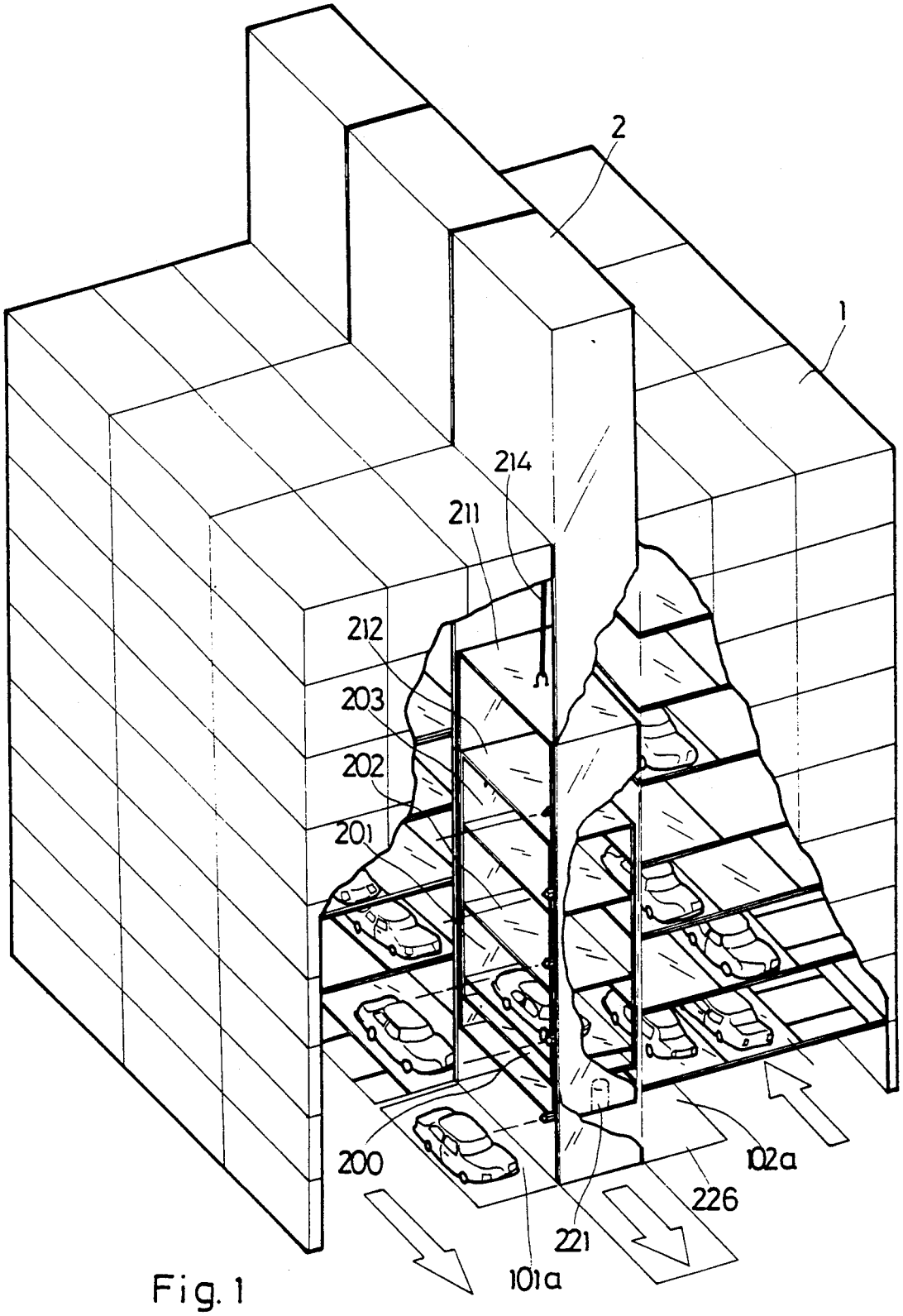
FIG. 1 is a perspective view of a multi-story transverse shifting type automatic parking device embodying the present invention.
Figure 2:
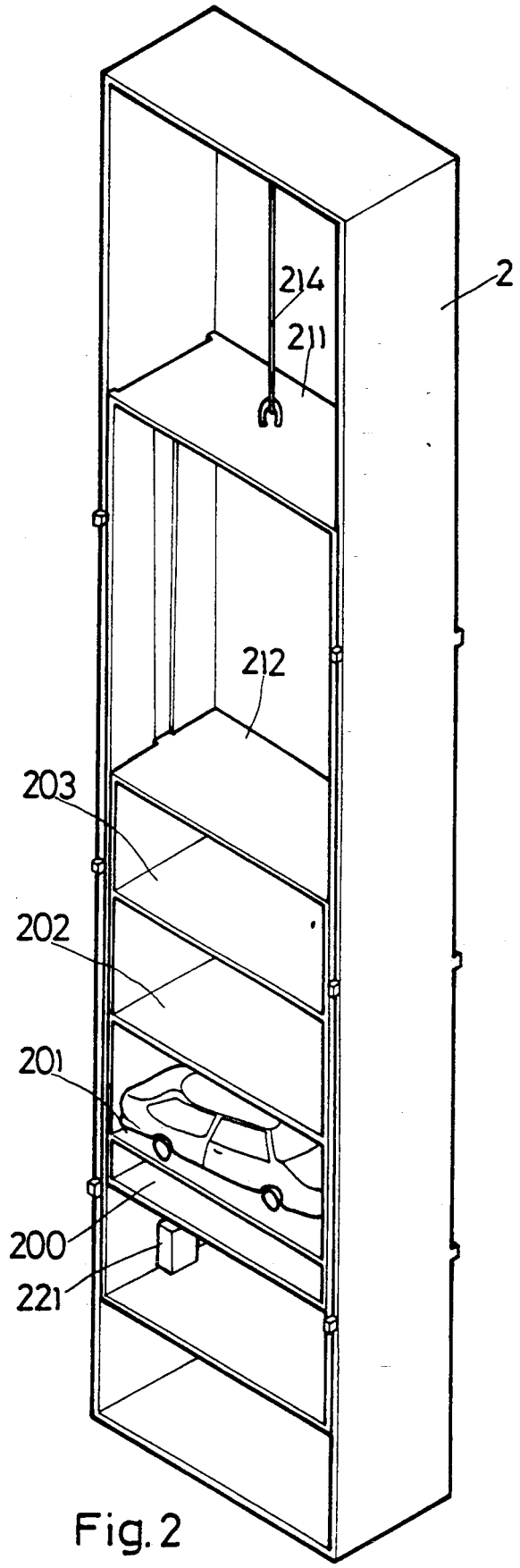
FIG. 2 is a perspective view of the lifting gear mainframe.
Figure 3:
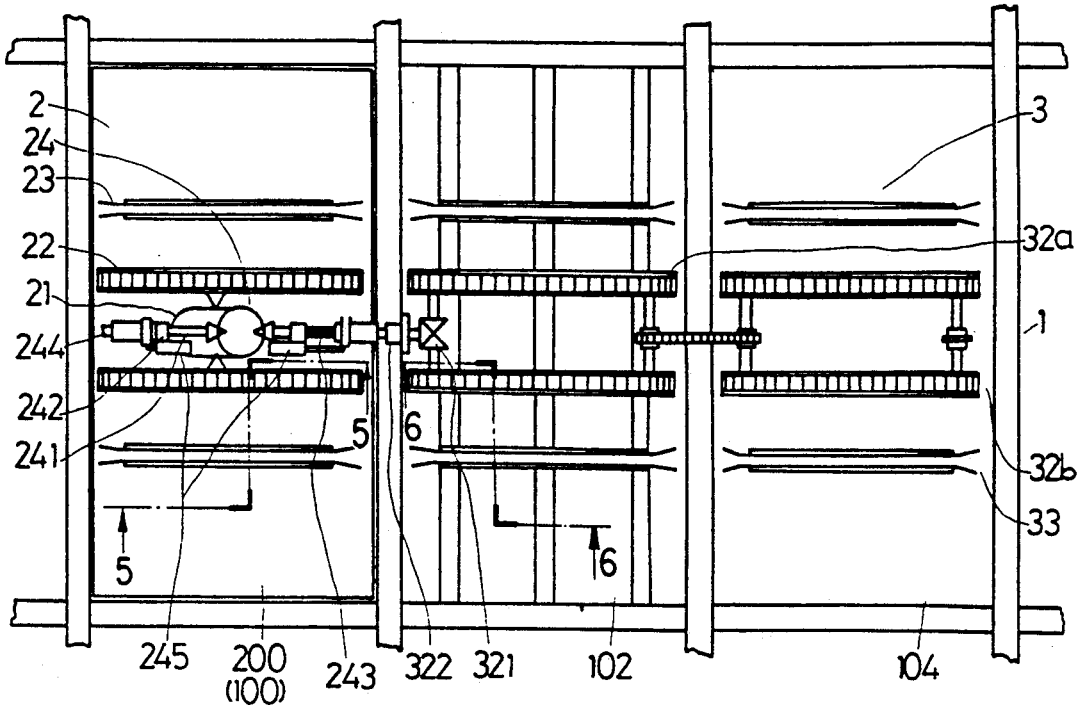
FIG. 3 is a top view showing that the driving mechanism in either floor of the multi-story daughter elevator is coupled with the transverse shifting mechanism in either floor of the multi-story parking building above the ground floor thereof.

Referring to FIGS. 1, 2 and 3, in a multi-story parking building 1 there is installed a lifting gear mainframe 2 which is comprised of a mother elevator 211 with a multi-story daughter elevator 212 fastened therein. The mother elevator 211 is carried by a steel rope 214 to move up and down in the lifting gear mainframe 2. The multi-story daughter elevator 212 is controlled by a hydraulic lift 221 to move up and down in the mother elevator 211. In the present preferred embodiment, the lifting gear mainframe 2 is installed in the multi-story parking building 1 at the middle. The number of floors of the multi-story daughter elevator 212 is determined, in addition to a spare floor 200 for carrying a spare carrier, according to the maximum number of parking units in each floor at either lateral side by the lifting gear mainframe 2.

Figure 4:
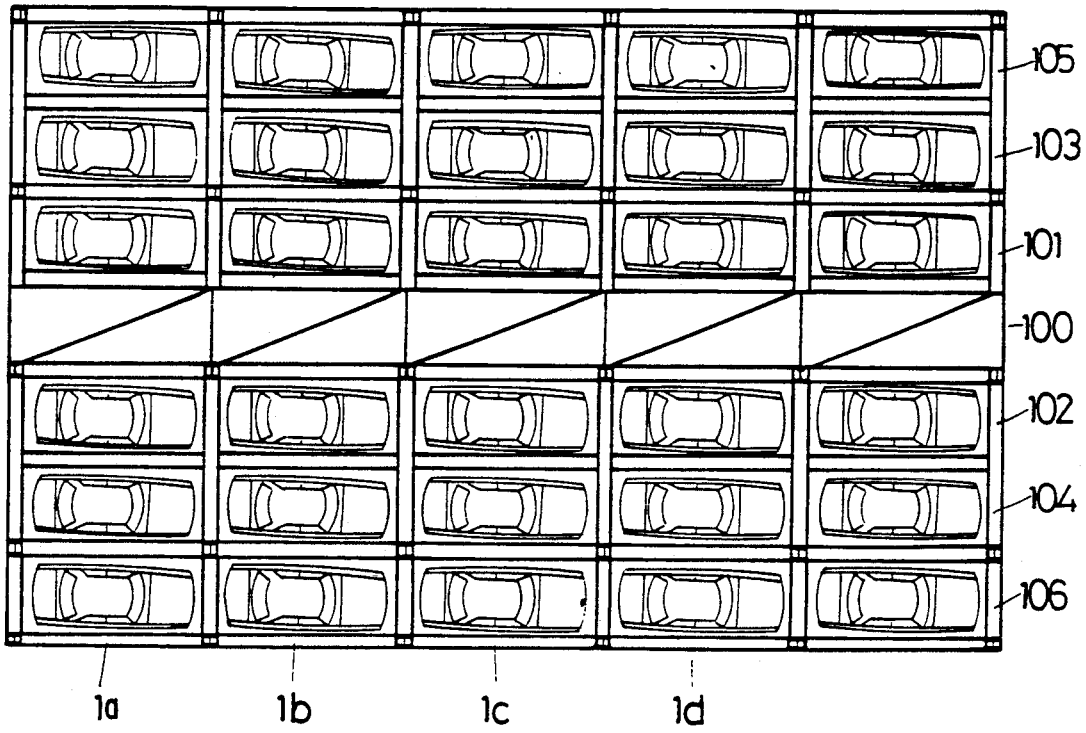
FIG. 4 is a top view of either floor in the multi-story parking building.
Figure 5:
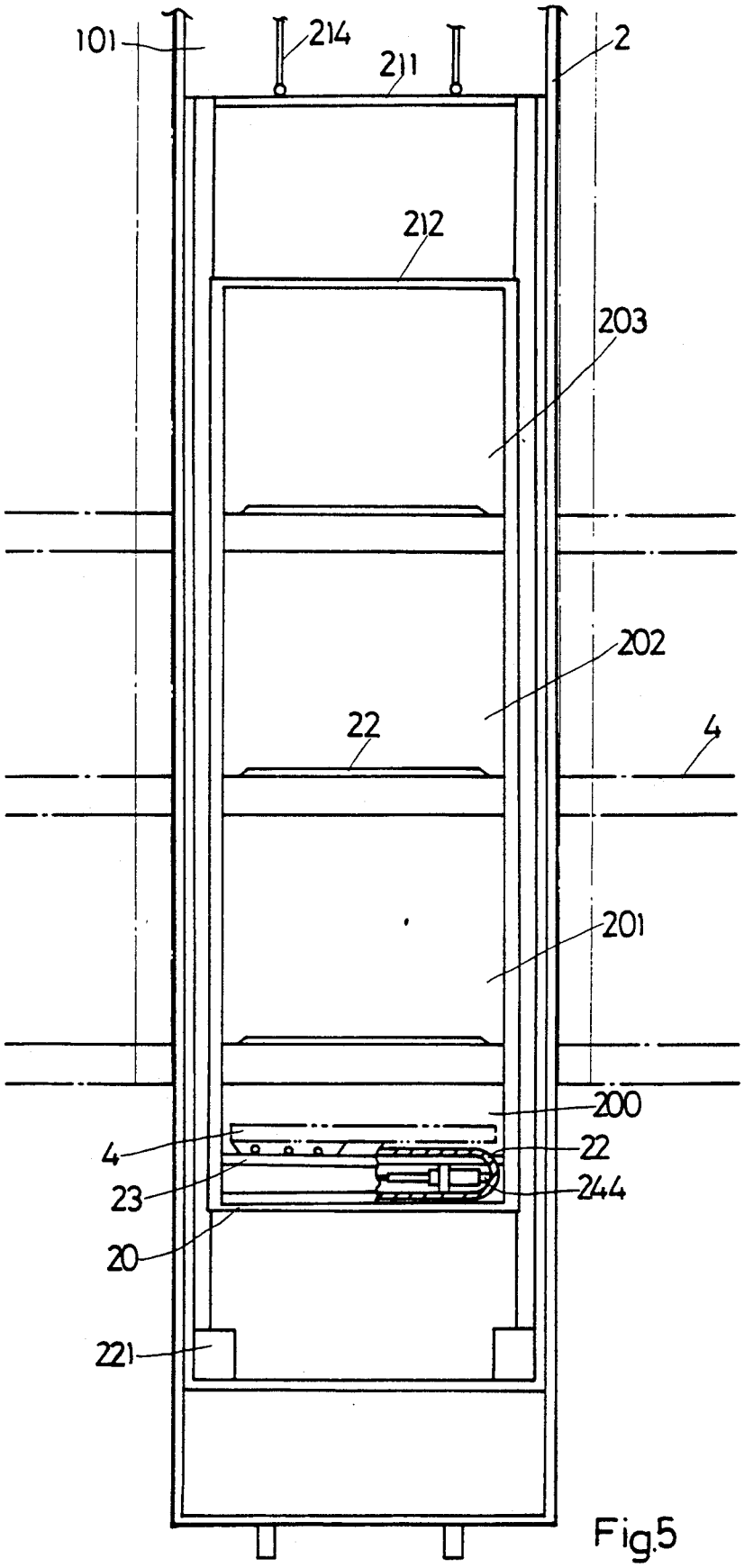
FIG. 5 is a front view of the multi-story daughter elevator (namely, sectional view taken on line 5—5 of FIG. 3)

Referring to FIG. 4 and as seen in FIG. 3 again, each floor of the multi-story parking building 1 is divided into a plurality of equal blocks longitudinally and latitudinally aligned, in which each row 1*a*, 1*b*, 1*c*, 1*d* . . . and etc., consists of a common entrance 100 at the middle and a plurality of parking units 101, 102, 103, 104, 105, 106 . . . and etc., bilaterally disposed at two opposite sides. However, the two blocks adjacent to the common entrance 100 on each row on the ground floor shall be reserved for use as spare parking units 226 so that automobiles can drive in and out conveniently.

Figure 6:
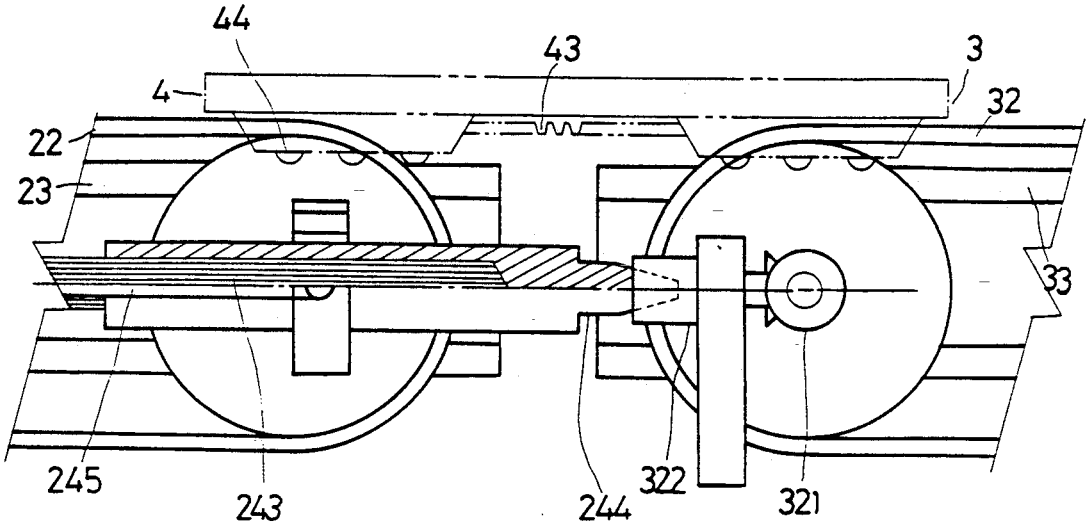
FIG. 6 is a front view of the transverse shifting mechanism (namely, sectional view taken on line 6—6 of FIG. 3)
Figure 8:
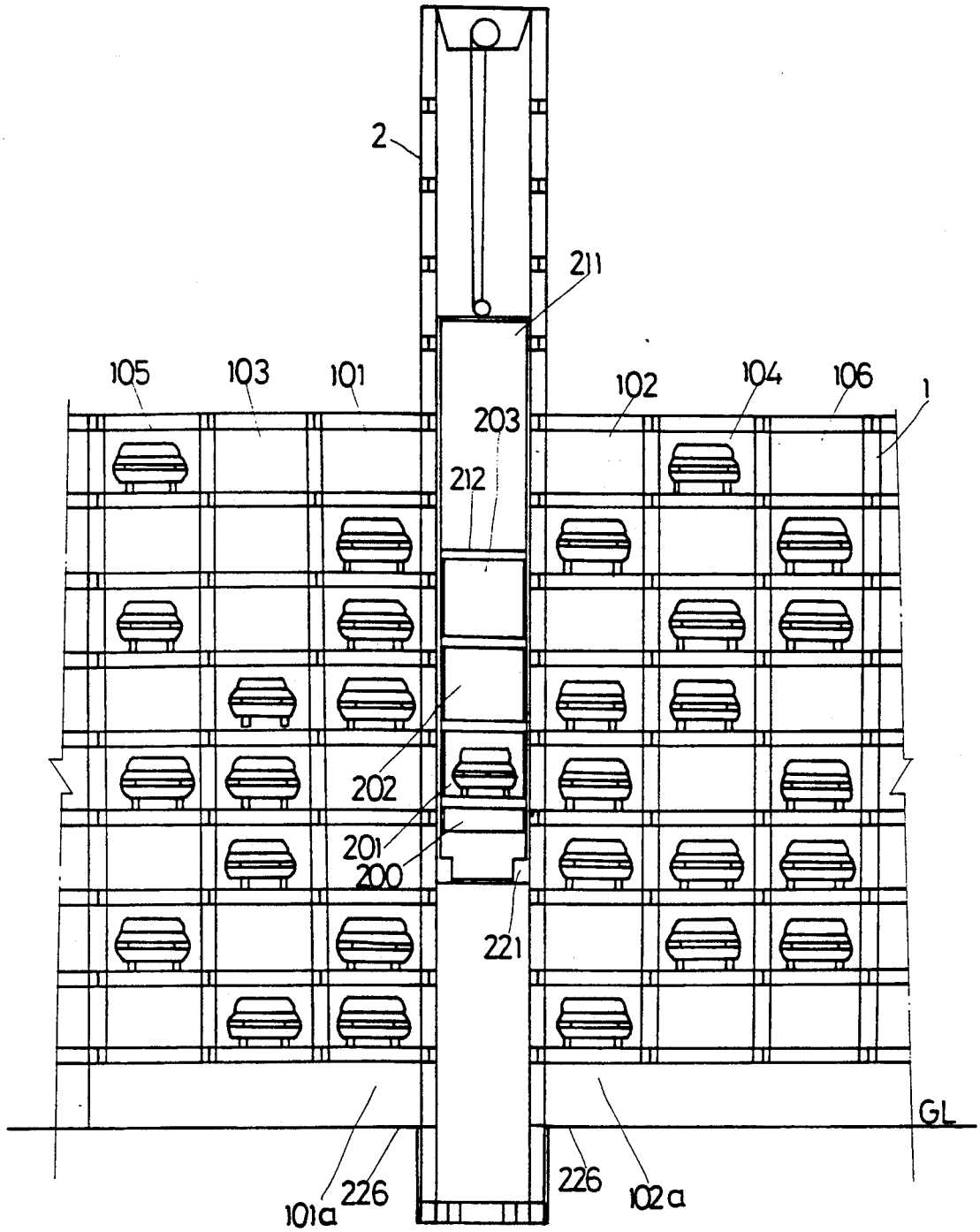
FIG. 8 is a side view of the multi-story parking building showing the parking of cars therein.

As indicated, the lifting gear mainframe 2 is comprised of a mother elevator 211 with a multi-story daughter elevator 212 movably set therein. By means of lifting the mother elevator 211 and/or the multi-story daughter elevator 212 in the mother elevator 211, either floor in the multi-story daughter elevator 212 can be moved to transversely align with either floor in the multi-story parking building 1 for parking or picking up an automobile. Further, the number of floors in the multi-story daughter elevator 212 is determined according to the maximum parking units at either side on each floor. For example, if there are three parking units at the left side by the entrance 100 in either row and two parking units at the right side by the entrance 100 in the same row, the multi-story daughter elevator 212 shall be made in a three-story structure with an additional spare floor 200 disposed at the bottom for carrying a spare carrier (see FIG. 8). Each floor 200, 201, 202, . . . of the multi-story daughter elevator 212 has a power unit supported by a base plate 20 for carrying an automobile loaded carrier or a vacant carrier in or out, each power unit is comprised of a driving mechanism 21, which is comprised of a motor and a speed change gear, a set of chain conveyers 22 driven to rotate by said driving mechanism 21, a set of tracks 23 disposed in parallel with said set of chain conveyers 22 for carrying a carrier, two transverse shifting mechanisms 3 (see FIGS. 3 and 6) and power output mechanisms 24. Each power output mechanism 24 is comprised of a power output shaft 241 on the driving mechanism 21, a torque limiter and clutch set 242 mounted on said power output shaft 241 at the front, a rack 243 carried to rotate by said power output shaft 241 through said torque limiter and clutch set 242, a tapered socket 244 mounted on said screw rod 243 and controlled by a hydraulic cylinder 245 to move on said screw rod 243 in axial direction and to transmit driving power to either transverse shifting mechanism 3. The two transverse shifting mechanisms 3 are bilaterally fastened at two opposite sides by the entrance 100 in each floor in the multi-story parking building 1, namely, one transverse shifting mechanism 3 is fastened in the left-sided parking units 101, 103, . . . and etc., on each floor and driven by the left-sided power output mechanism 24 in either floor of the multi-floor daughter elevator 212 to carry the carriers on the left-sided parking units toward or away from the entrance 100 on the same floor, the mother transverse shifting mechanism 3 is fastened in the right-sided parking units 102, 104, . . . and etc., on the same floor and driven by the right-sided power output mechanism 24 in the same floor of the multi-floor daughter elevator 212 to carry the carriers on the right-sided parking units toward or away from the entrance on the same floor. Each transverse shifting mechanism 3 is comprised of plural sets of chain conveyers 32 and plural sets of tracks 33 respectively arranged at locations corresponding to the set of chain conveyers 22 and the set of tracks 23 on either floor in the multi-story daughter elevator 212. The first set of chain conveyer 32*a* adjacent to the entrance 100 in either floor (including the ground floor) at either side has a planet gear 321 and a tapered connector 322 on the power input shaft thereof to receive the power transmitted through the tapered socket 244 on the corresponding power output mechanism 24, and therefore, the first set of chain conveyers 32*a* will be caused to rotate. The other sets of chain conveyers 32*b*, 32*c*, . . . and etc., at the same side on the same floor are respectively coupled to the first set of chain conveyer 32*a* for synchronous motion (see FIGS. 3 and 6).

Figure 7:
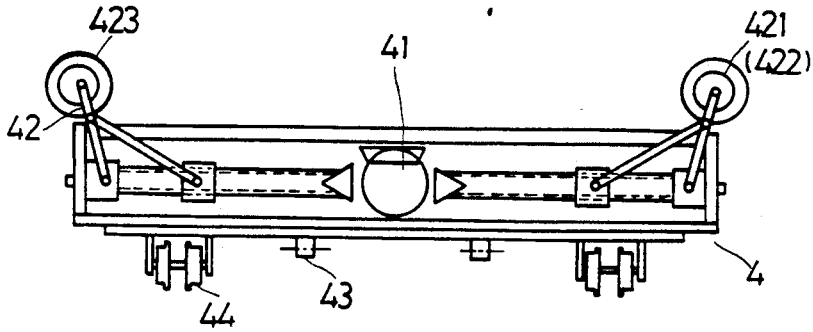
FIG. 7 is a side view of the carrier.

Referring to FIG. 7, a carrier 4 each is respectively placed on each parking unit in the multi-story parking building 1 and each floor in the multi-story daughter elevator 212 for supporting an automobile. Each carrier 4 has a set of racks 43 and a plurality of rollers 44 on the bottom edge thereof corresponding to the sets of chain conveyers 22, 32 and the sets of tracks 23, 33, and a car tire fastening mechanism at the top for holding an automobile supported thereon, which car tire fastening mechanism is comprised two symmetrical clamping linkages 42 driven to operate by a motor 41 via a torque limiter and clutch set, which symmetrical clamping linkages 42 each has an adjustable bearing 422 mounted on a clamping rod 421 and covered with an anti-skid, shock-absorbing rubber covering 423 for holding either tire of the automobile loaded thereon. By means of the operation of the sets of chain conveyers 22, 32, the carrier 4 is moved back and forth on the sets of tracks 23, 33.

The present invention is automatically controlled by a computer system which records the vacancy of the parking units in the parking building and controls the mother elevator 211 and the multi-story daughter elevator 212 to move up and down, turns on/off the driving mechanism 21 and the power output mechanism 24 in either floor of the multi-story daughter elevator 212 and, turns on/off the car tire fastening mechanism in either carrier 4 on the ground floor. The operation of the present invention will now be outlined hereinafter (for better understanding parking procedure is described for parking a car onto either parking unit at the right-sided part of the parking building).

(1) Before parking: The mother elevator 211 is moved to the bottom in the lifting gear mainframe 2 and, the multi-story daughter elevator 212 is moved to the bottom in the mother elevator 211 adjacent to the first two parking units 101*a*, 102*a* which are disposed at two opposite sides adjacent to the entrance 100 on the ground floor. The other space in the ground floor beyond the first two parking units 101*a*, 102*a* is not for parking but serves as traffic lanes for passing therethrough or temporary stopping of the cars to be parked. Carriers 4 are respectively loaded on the sets of chain conveyers 22, 32*a*, 32*b*, . . . and etc.

(2) Entrance of a car to be parked onto either carrier on the ground floor: When a car drives in the multi-story parking building 1 for parking, the keeper gives a magnetic card to the car driver and instructs the car driver to stop the car on the vacant carrier 4 on the parking unit 101*a* or 102*a* at either side. Once the car is stopped, the car driver gets out of the car and inserts the magnetic card in a card reader which is connected to the computer system for on-line operation. After reading the card, the computer system gives a command to turn on the motor 41 on the carrier 4 (the control circuit is not within the scope of the present invention, and therefore, it is not shown) causing the linked clamping rods 421 to firmly clamp the tires of the car. Once the tires of the car are firmly clamped by the linked clamping rods 421, the motor 41 is stopped automatically and, the magnetic card is ejected by the card reader with the entrance time recorded therein. After recording, the card is handed to the car driver, and the carrier 4 as well as the car supported thereon will be carried to the designated parking unit automatically by means of the control of the computer system. If the car is not properly parked on the carrier 4 causing clamping or lifting failure, the clamping linkage 42 will be moved back to its original position and at the same time, a warning lamp or speech synthesizer will give a warning to the car driver telling him (her) to park the car again.

(3) Entrance of a car to be parked into the multi-story daughter elevator: Once the aforesaid step (2) is completed, an output signal from the computer system is given to turn on the driving mechanism 21 in the first floor 201 of the multi-story daughter elevator 212 so as to carry the corresponding set of chain conveyers 22 and caused the screw rod 243 to rotate. At the same time, the corresponding hydraulic cylinder 245 is moved out permitting the tapered socket 244 to engage into the tapered connector 322 of the set of chain conveyers 32*a* in the first parking unit 102*a* on the ground floor, and therefore, the set of chain conveyers 32*a* is caused to rotate. By means of the operation of the sets of chain conveyers 32*a*, 22 and the racks 43, the carrier 4 and the car thereon are carried by the rollers 44 thereof into the first floor 201 of the multi-story daughter elevator 212. Once the carrier 4 and the car thereon have been moved into the first floor 201 of the multi-story daughter elevator 212, another signal is given to the hydraulic cylinder 245 causing it to move back the tapered socket 244 and, at the same time, power supply is cut off from the driving mechanism 21 (The same procedure will be performed to carry a carrier from the multi-story daughter elevator 212 to either parking unit in either floor or from either parking unit in either floor to the multi-story daughter elevator 212). Then, the multi-story daughter elevator 212 is lifted upwards and then stopped at a position with the spare floor 200 therein to be horizontally aligned with the ground of the floor in the parking building 1. Once the spare floor 200 is lifted into position, the driving mechanism 21 in the spare floor 200 is turned on to carry the sets of chain conveyers 22, 32*a* in the spare floor 200 and the ground floor 102*a*, and therefore, the vacant carrier 4 in the spare floor 200 is moved out of the multi-story daughter elevator 212 to the first parking unit 102*a*. Once the carrier 4 is moved from the spare floor 200 onto the first parking unit 102*a*, the driving mechanism 21 is stopped.

Figure 9:
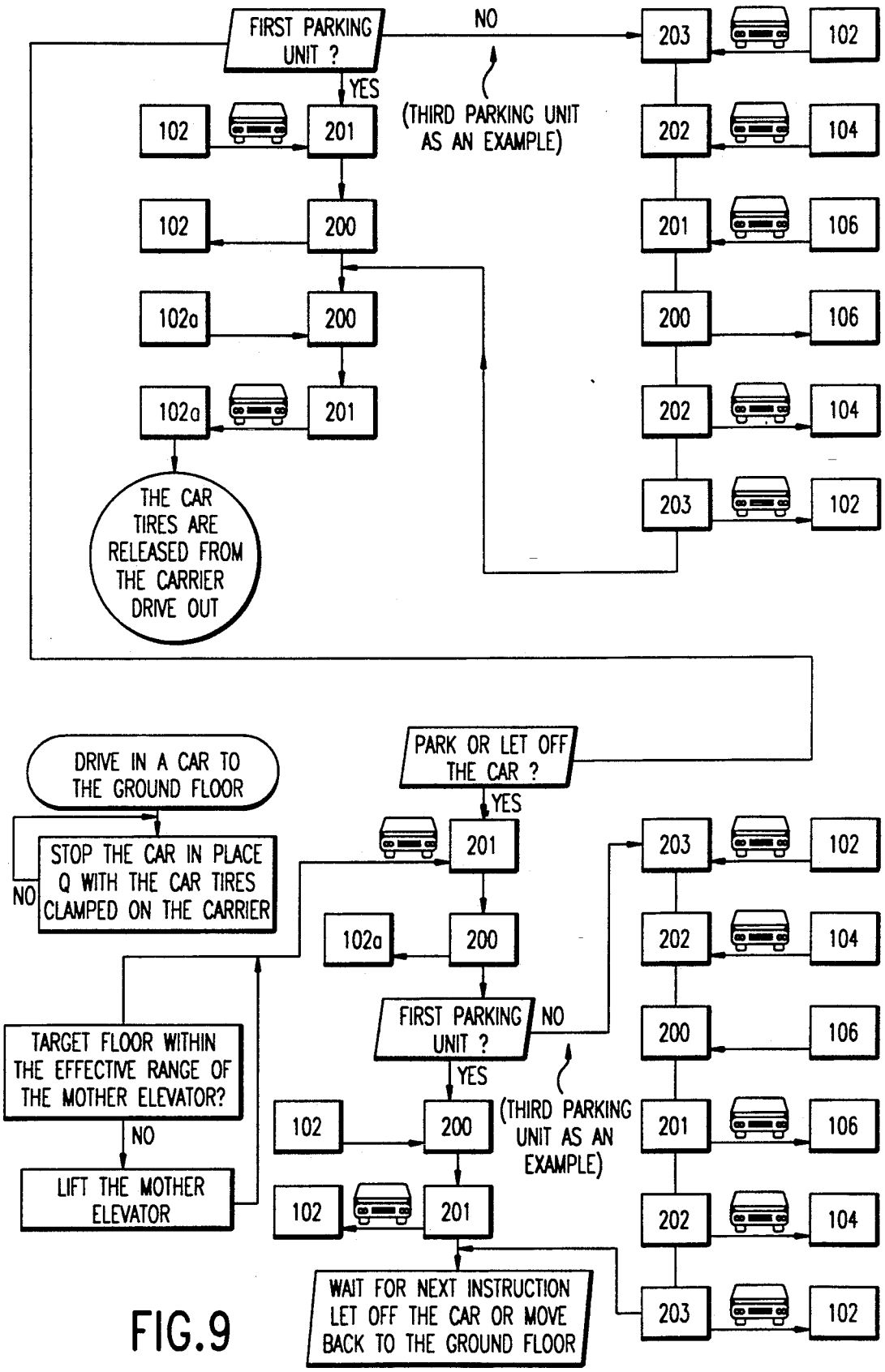
FIG. 9 is a flow chart showing the operation of the present invention in parking or carrying out a car.

(4) Parking of a car onto either parking unit in either floor in the parking building: After the aforesaid step (3), the mother elevator 211 and/or the multi-story daughter elevator 212 are moved upwards according to the record in the magnetic card. If a car is to be parked in the first parking unit adjacent to the entrance at either side in either floor within the level of the height of the mother elevator 211 where the spare floor 200 of the multi-story daughter elevator 212 can reach without lifting the mother elevator 211, the multi-story daughter elevator 212 is moved upwards in the mother elevator 211 and set in position permitting the spare floor 200 to be horizontally flush with the target floor. Once the spare floor 200 of the multi-story daughter elevator 212 is set in position and detected by a detector (not shown), an output signal is given to stop the multi-story daughter elevator 212 and simultaneously to turn on the driving mechanism 21 in the spare floor 200 so as to rotate the sets of chain conveyers 22, 32 in the spare floor 200 and the first parking unit 101 or 102 on the target floor (according to the command from the computer system; the right-sided parking unit 102 is described hereinafter as an example). When the sets of chain conveyers 22, 32 are rotated, the vacant carrier on the right-sided first parking unit 102 is moved onto the spare floor 200 in the multi-story daughter elevator 212. Once the vacant carrier 4 is properly positioned in the spare floor 200, another signal is given to cut off power supply from the driving mechanism 21, and then, the multi-story daughter elevator 212 is moved downwards to such a position that the first floor 201 in which the car to be parked is carried is flush with the target floor. Immediately thereafter, the driving mechanism 21 in the first floor 201 in the multi-story daughter elevator 212 is driven to rotate the sets of chain conveyers 22, 32 in the first floor 201 of the multi-story daughter elevator 212 and the first parking unit 102 on the target floor, and therefore, the carrier 4 and the car thereon is moved from the first floor 201 of the multi-story daughter elevator 212 to the first parking unit 102 of the target floor. Once the car is parked, a signal is given to cut off power supply from the driving mechanism 21. The mother elevator 211 and the multi-story daughter elevator 212 may be left in place or directly moved down to the ground floor for further operation. If a car is to be parked in the second, third or any parking unit other than the first parking unit adjacent to the entrance at either side in either floor above the level two floors below the height of the mother elevator 211 where the spare floor 200 of the multi-story daughter elevator 212 can not reach without lifting the mother elevator 211, the mother elevator 211 is moved upwards to such a position that the spare floor 200 of the multi-story daughter elevator 212 can reach, then, the multi-story daughter elevator 212 is moved upwards in the mother elevator 211 and set in position permitting the second floor 202 thereof to be flush with the target floor (The following description describes parking a car in the second parking unit; for parking a car to the third parking unit, the third floor of the multi-story daughter elevator shall be firstly set flush with the target floor, as shown in FIG. 9). Once the second floor 202 is flush with the target floor and detected, a signal is given to stop the multi-story daughter elevator 212 and at the same time, the driving mechanism 21 in the second floor 202 of the multi-story daughter elevator 212 is turned on to rotate the set of chain conveyers 22 in the second floor 202 and the set of chain conveyers 32 in the first parking unit 102 of the target floor in the parking building 1, permitting the carrier 4 on the first parking unit 102 and the car thereon to be moved into the second floor 202 of the multi-story daughter elevator 212. Once the carrier 4 which was originally supported on the first parking unit 102 of the target floor in the parking building 1 and the car thereon have been moved to the second floor 202 of the multi-story daughter elevator 212, a signal is given to cut off power supply from the driving mechanism 21. Then, the multi-story daughter elevator 212 is moved upwards permitting the spare floor 200 thereof to be flush with the target floor of the parking building 1. Then, repeat the aforesaid procedure to let the vacant carrier 4 which was originally placed on the second parking unit 104 to be moved into the spare floor 200 and at the same time, to let the carrier 4 in the first floor 201 of the multi-story daughter elevator 212 and the car thereon to be moved into the second parking unit 204 in the target floor of the parking building 1. Moving the mother and daughter elevators 211, 212 is determined according to the level of the target floor to reach, i.e., the daughter elevator 212 is moved while the mother elevator 211 remains immovable if the target floor is within the effective range of the mother elevator 211, or the mother elevator 211 (with the daughter elevator 212 therein) is carried by the steel rope to a suitable level position, if the target floor is out of the effective range of the mother elevator 211, so that the spare floor 200 of the daughter elevator 212 can be moved to reach the target floor.

(5) Taking a car from a specific parking unit: The car driver gives the magnetic card to the keeper for checking out. After check-out, the computer system instructs the multi-story daughter elevator 212 to move the car from the specific parking unit to the first parking unit 101*a* or 102*a* on the ground floor of the parking building 1. Once the car driver inserts the magnetic card in the card reader, the computer system automatically instructs the motor 41 in the carrier 4 on the first parking unit 101*a* or 102*a* to rotate backwards so as to release the clamping linkage 42 from the car tires. As soon as the car is released from the clamping linkage 42, the magnetic card is ejected from the card reader and, the car driver can take the magnetic card from the card reader and drive the car away from the parking building 1.

Figure 10:
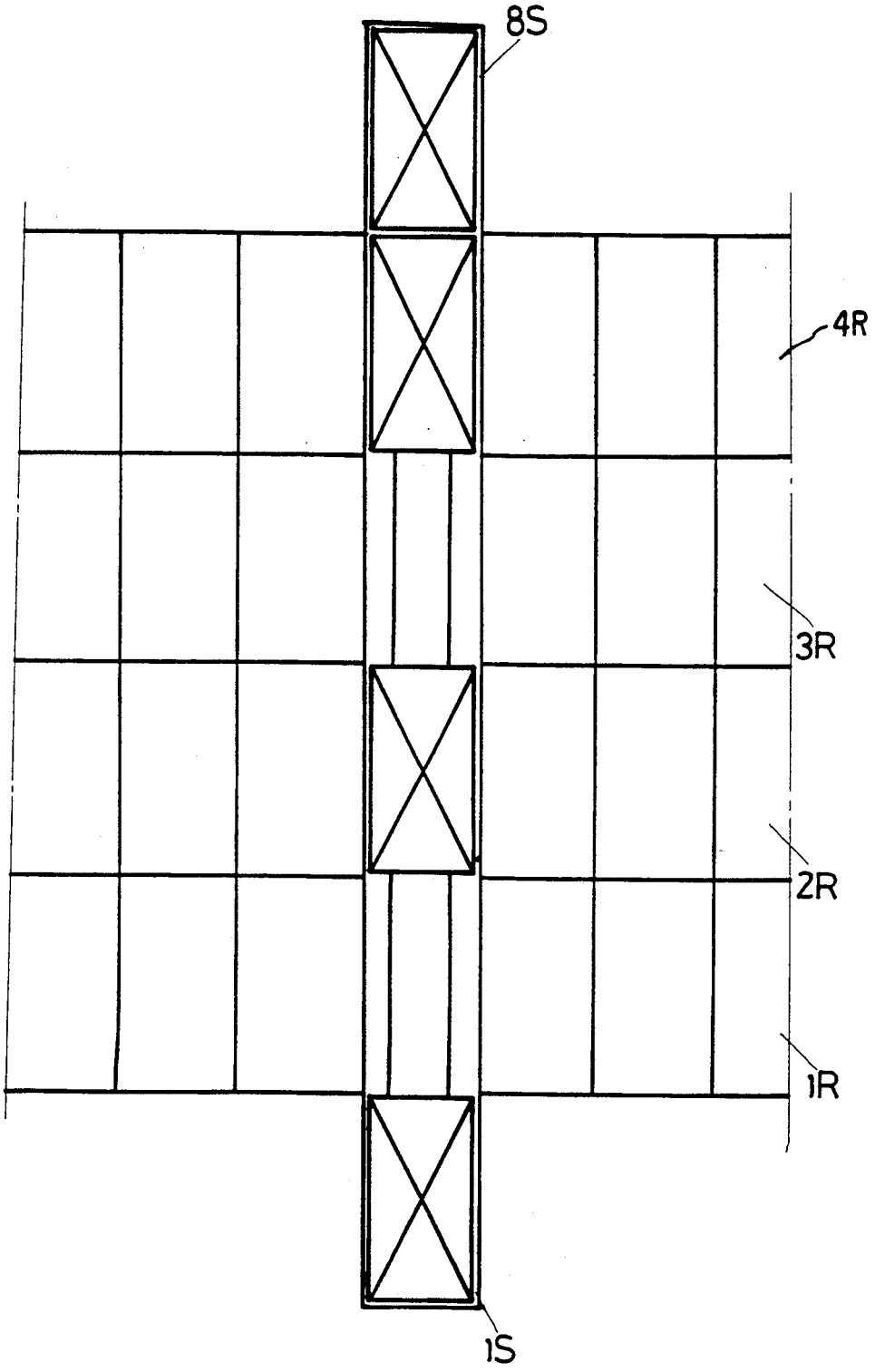
FIG. 10 is a plan view showing that two spare spaces are provided for moving the two lifting gear mainframes at two opposite ends.

Referring to FIG. 10, when each floor in a parking building according to the present invention is comprised of several rows of parking units 1R, 2R, 3R, and 4R (each row of parking units includes an independent lifting gear mainframe at the middle), two spare spaces 1S, 8S may be provided at two opposite ends so that either lifting gear mainframe can be moved forwards or backwards from one row to the preceding or following row so as to make parking easy. While four rows of parking units are shown, it will be obvious that any additional number may be included. As an example, a car which is loaded on a carrier in the lifting gear mainframe 2 on the ground floor of the parking building 1 at the second row 2R is to be parked in either parking unit in the third floor of the parking building 1 at the third row 3R, the mainframes at the third and fourth rows 3R, 4R can be moved backwards permitting the lifting gear mainframe at the last row to be moved into the rear spare space 8S, and therefore, the lifting gear mainframe at the second row 2R is moved to the third row 3R. While moving toward to the fourth row 4R, the mother and daughter elevators in the lifting gear mainframe are simultaneously operated. Therefore, as soon as the lifting gear mainframe is moved from the third row 3R to the fourth row 4R, the car in the daughter elevator 212 is simultaneously moved to the third floor of the parking building 1 for carrying to the designated parking unit. This arrangement makes parking operation more efficient.

As indicated, the multi-story transverse shifting type automatic parking device of the present invention utilizes a lifting gear mainframe and a transverse shifting mechanism to carry a car to be parked to either parking unit in either floor so that the holding space in the multi-story transverse shifting type automatic parking device can be fully utilized. The size of the parking building can be flexibly made according to the ground area available. Further, each carrier has a clamping linkage which is suitable for holding any of a variety of motor vehicles in place.

What is claimed is:

1. A multi-story transverse shifting type automatic parking device comprising:

a multi-story parking building, each floor of which being divided into at least one row of equal sized parking units, an elevator passageway centrally located within the building extending upwardly through each floor and having at least two parking units in each row on opposite sides of the passageway;

at least one lifting gear mainframe respectively installed in said elevator passage way in said multi-story parking building and driven to move horizontally from one row to another when a plurality of rows are disposed on each floor, said at least one lifting gear mainframe comprising a mother elevator driven to move vertically within said passageway, and a multi-story daughter elevator driven to move vertically in said mother elevator, said multi-story daughter elevator having a predetermined number of floors and a spare floor disposed at the lowest level thereof;

a plurality of pairs of transverse shifting mechanisms respectively mounted on each floor in said multi-story parking building, one of each said paris being mounted adjacent said elevator passageway both said opposite sides thereof in each of said rows;

a plurality of carriers respectively placed on each of the parking units on each floor in said multi-story parking building and on the spare floor of said multi-story daughter elevator; and means for moving said mother and daughter elevators and said transverse shifting mechanisms to carry a car to be parked to any parking unit on any floor in the multi-story parking building and to take a car from a specific parking unit on any floor in the multi-story parking building to the elevator passageway and to the ground floor of said building; said building further including on the ground floor at two opposite sides adjacent to the elevator passageway traffic lanes for the cars to be parked.

2. The parking device of claim 1, wherein each floor of said multi-story parking building is divided into a plurality of parallel rows of equal units, each row of equal units having the elevator passageway centrally located therein with at least two parking units on each side thereof.

3. The parking device of claim 2, wherein said mother elevator is higher than said multi-story daughter elevator so that said multi-story daughter elevator can be moved up and down therein and, the number of floors in said multi-story daughter elevator is determined according to the maximum number of parking units available in each row on each side of the elevator passageway.

4. The parking device of claim 3, wherein said multi-story daughter elevator comprises a plurality of floors and a spare floor, a power unit supported on a base plate mounted on each of said plurality of daughter elevator floors and on said daughter elevator spare floor, said power unit comprising a driving mechanism, and transverse conveying means driven by said driving mechanism.

5. The parking device of claim 1, wherein said multi-story parking building comprises a first spare elevator passageway through each floor at one end of said building for the lifting gear mainframe at the elevator passageway of the last row of parking units thereon and a second spare elevator passageway through each floor at an opposite end of said building for the lifting gear mainframe of the first row of parking units thereon.

* * * * *